US006816139B2

(12) United States Patent
Park

(10) Patent No.: US 6,816,139 B2
(45) Date of Patent: Nov. 9, 2004

(54) APPARATUS FOR DRIVING LIQUID CRYSTAL DISPLAY (LCD) PANEL AND LCD PANEL DRIVING SYSTEM ADOPTING THE APPARATUS

(75) Inventor: Kwan-seon Park, Suwon (KR)

(73) Assignee: Samsung Electronics Co., Ltd. (KR)

( * ) Notice: Subject to any disclaimer, the term of this patent is extended or adjusted under 35 U.S.C. 154(b) by 260 days.

(21) Appl. No.: 10/008,776

(22) Filed: Nov. 13, 2001

(65) Prior Publication Data

US 2002/0093498 A1 Jul. 18, 2002

(30) Foreign Application Priority Data

Jan. 15, 2001 (KR) ..... 2001-2173

(51) Int. Cl.[7] ..... G09G 3/36

(52) U.S. Cl. ..... 345/87; 345/3.1; 345/3.4; 345/699

(58) Field of Search ..... 345/87, 3.1, 3.4, 345/698, 699

(56) References Cited

U.S. PATENT DOCUMENTS 5,276,458 A * 1/1994 Sawdon ..... 345/698
5,977,934 A * 11/1999 Wada et al. ..... 345/3.1
6,008,794 A * 12/1999 Ishii ..... 345/150

FOREIGN PATENT DOCUMENTS

KR 1999-0069689 6/1999 ..... G06F/3/14

* cited by examiner

*Primary Examiner*—Jimmy H. Nguyen
(74) *Attorney, Agent, or Firm*—Mills & Onello LLP

(57) ABSTRACT

A panel driving apparatus compatible with various types of panels for liquid crystal displays (LCDs) having different specifications and a panel driving system adopting the panel driving apparatus include: a microcontroller; a data converting unit controlled by the microcontroller, for receiving composite data including color data and horizontal and vertical synchronization signals and for generating converted composite data and a clock signal; a panel control unit controlled by the microcontroller, for receiving the converted composite data and the clock signal and for generating control signals for driving a panel, and an internal data signal including the color data and the clock signal; and a transmitting unit for receiving the internal data signal from the panel control unit and for transmitting the received internal data signal to the panel. The panel driving apparatus and the panel driving system generate a variety of control signals, which are programmed by the microcontroller depending on the specifications for a particular panel, and thus they are applicable to various types of the panels having different specifications, without need to be manufactured as ASICs, thereby reducing the manufacturing cost.

5 Claims, 6 Drawing Sheets

APPARATUS FOR DRIVING LIQUID CRYSTAL DISPLAY (LCD) PANEL AND LCD PANEL DRIVING SYSTEM ADOPTING THE APPARATUS

BACKGROUND OF THE INVENTION

1. Field of the Invention

The present invention relates to a liquid crystal display (LCD), and more particularly, to an apparatus for driving various types of thin-film transistor liquid-crystal display (TFT LCD) panels having different specifications.

2. Description of the Related Art

Generally, a TFT LCD driver for driving a TFT LCD panel includes gate drivers for driving gate lines (or row lines) of TFTs and source drivers for driving source lines (or column lines) of TFTs. When the gate drivers activate the TFTs by the application of a high voltage, the source drivers apply source driving signals to the respective source lines for displaying colors, and, as a result, a color picture is displayed on the LCD.

However, the characteristics or driving methods of a driver integrated circuit (IC) such as a gate driver or a source driver, and the characteristics, size and resolution of a panel vary from one LCD manufacturing company to another, and even between LCDs produced by the same company, that have different product specifications. Thus, the timing of a control signal for a LCD panel or a driver IC varies, depending on the product specifications of the LCD panel, and controllers for panels and driver ICs have been manufactured as application-specific integrated circuits (ASICs), resulting in numerous diversified panels or driver controllers.

FIG. 1 is a block diagram of a conventional LCD panel driving system. Referring to FIG. 1, the conventional panel driving system 100 includes a graphics card 110, a display unit 170 including a panel 193 for an LCD, and a panel driving apparatus 120.

The panel driving apparatus 120 receives composite data DATA_S including color data and vertical and horizontal synchronization (sync) signals (not shown) from the graphics card 110, converts the composite data DATA_S into a suitable form for the specifications of the panel 193, and transmits a converted composite data DATA_SS to the display unit 170. The panel driving apparatus 120 includes a microcontroller 160, a data converting portion 130 controlled by the microcontroller 160 for receiving and converting the composite data DATA_S and generating a converted composite data CDATA_S and a clock signal CLOCK, a scaler 140 controlled by the microcontroller 160 for scaling the converted composite data CDATA_S, and a transmitting portion 150 for receiving an output signal SCDATA_C and the clock signal CLOCK and transmitting the converted composite data DATA_SS and the clock signal CLOCK to the display unit 170.

The display unit 170 includes a receiving portion 180, a timing control portion 190, and the panel 193. The receiving portion 180 receives the composite data DATA_SS and the clock signal CLOCK transmitted from the transmitting portion 150, and transmits the received composite data DATA_SS and the clock signal CLOCK to the timing control portion 190. The timing control portion 190 applies control signals CSG suitable for the specifications of the panel 193 to the panel 193 to drive the same. The panel 193 is driven by a source driver 196 and a gate driver 199.

In the conventional panel driving system of FIG. 1, the panel driving apparatus 120 receives the composite data DATA_S from the graphics card 110, scales the composite data DATA_S according to the specifications of the panel 193, and applies the scaled composite data to the display unit 170. Here, the specifications of the panel 193 are classified according to panel size and resolution, and panel driving methods of drivers. The timing control portion 190 of the display unit 170 applies the control signals CSG according to the panel specifications to the panel 193.

However, since specifications greatly vary from one panel to another, the timing control portion 190 is limited to applying control signals CSG to the panel 193 that are compatible only with panels of like timing configuration. Since the timing control portion 190 is manufactured as an ASIC. Manufacture of the timing control ASIC in compliance with a variety of panels having different specifications, would cause the manufacturing cost of the LCD to increase.

SUMMARY OF THE INVENTION

To address the above limitations, it is a first object of the present invention to provide a panel driving apparatus for a thin-film transistor liquid crystal display (TFT-LCD) applicable to a variety of panels having different specifications.

It is a second object of the present invention to provide a LCD panel driving system adopting a panel driving apparatus compatible with a variety of panels having different specifications.

To achieve the first object of the present invention, there is provided a panel driving apparatus compatible with various types of panels for liquid crystal displays (LCDS) having different specifications, the apparatus comprising a microcontroller, a data converting unit, and a panel control unit, and a transmitting unit. The data converting unit is controlled by the microcontroller, receives composite data including color data and horizontal and vertical synchronization signals, and generates converted composite data and a clock signal. The panel control unit is controlled by the microcontroller, receives the converted composite data and the clock signal, and generates control signals for driving a panel and an internal data signal including the color data and the clock signal. The transmitting unit receives the internal data signal from the panel control unit and transmits the received internal data signal to the panel. It is preferable that the panel control unit comprises a scaler for scaling the converted composite data according to the specifications of the panel and a timing control portion for generating the control signals and the internal data signal.

To achieve the second object of the present invention, there is provided a panel driving system compatible with various types of panels for liquid crystal displays (LCDs) having different specifications, the panel driving system comprising a graphics card, a display device including a pane, and a panel driving apparatus for receiving composite data including color data and vertical and horizontal synchronization signals from the graphics card and generating control signals for driving the panel and a predetermined internal data signal. The panel driving apparatus includes: a microcontroller; a data converting unit controlled by the microcontroller, for receiving the composite data including the color data and the horizontal and vertical synchronization signals and generating converted composite data and a clock signal; a panel control unit controlled by the microcontroller, for receiving the converted composite data and the clock signal and generating the control signals for driving the panel, and the predetermined internal data signal including the color data and the clock signal; and a transmitting unit for receiving the predetermined internal data signal from the panel control unit and transmitting the received predetermined internal data signal to the panel.

It is preferable that the panel control unit comprises a scaler for scaling the converted composite data according to the specifications of the panel, and a timing control portion for generating the control signals and the internal data signal.

The microcontroller programs a variety of control parameters according to the specifications of the panel, stores the control parameters, and transmits the control parameters to the timing control portion.

The timing control portion preferably comprises an interface portion for receiving the color data, the vertical and horizontal synchronization signals, a data enable signal, and the control parameters from the microcontroller, and for generating first and second internal control signals and the internal data signal according to the specifications of the panel; a single control portion for receiving the first internal control signal and generating a single internal control signal for driving a panel having particular specifications; a double control portion for receiving the second internal control signal and generating a double internal control signal for driving another panel having different specifications; a data control portion for receiving the internal data signal and transmitting the received internal data signal to the transmitting unit; and a multiplexer for selecting one of the single internal control signal and the double internal control signal according to the specifications of the panel employed and generating the selected control signal as one of the control signals.

The system may further include a parallel-to-serial signal converting unit for receiving the control signals, for converting the received control signals to serial control signals, and for transmitting the serial control signals to the panel. In this case, the display device further comprises a serial-to-parallel signal converting unit for receiving the serial control signals, for converting the serial control signals to parallel control signals, and for transmitting the parallel control signals to the panel.

BRIEF DESCRIPTION OF THE DRAWINGS

The above objects and advantages of the present invention will become more apparent by describing in detail preferred embodiments thereof with reference to the attached drawings in which.

DETAILED DESCRIPTION OF PREFERRED EMBODIMENTS

Figure 1:
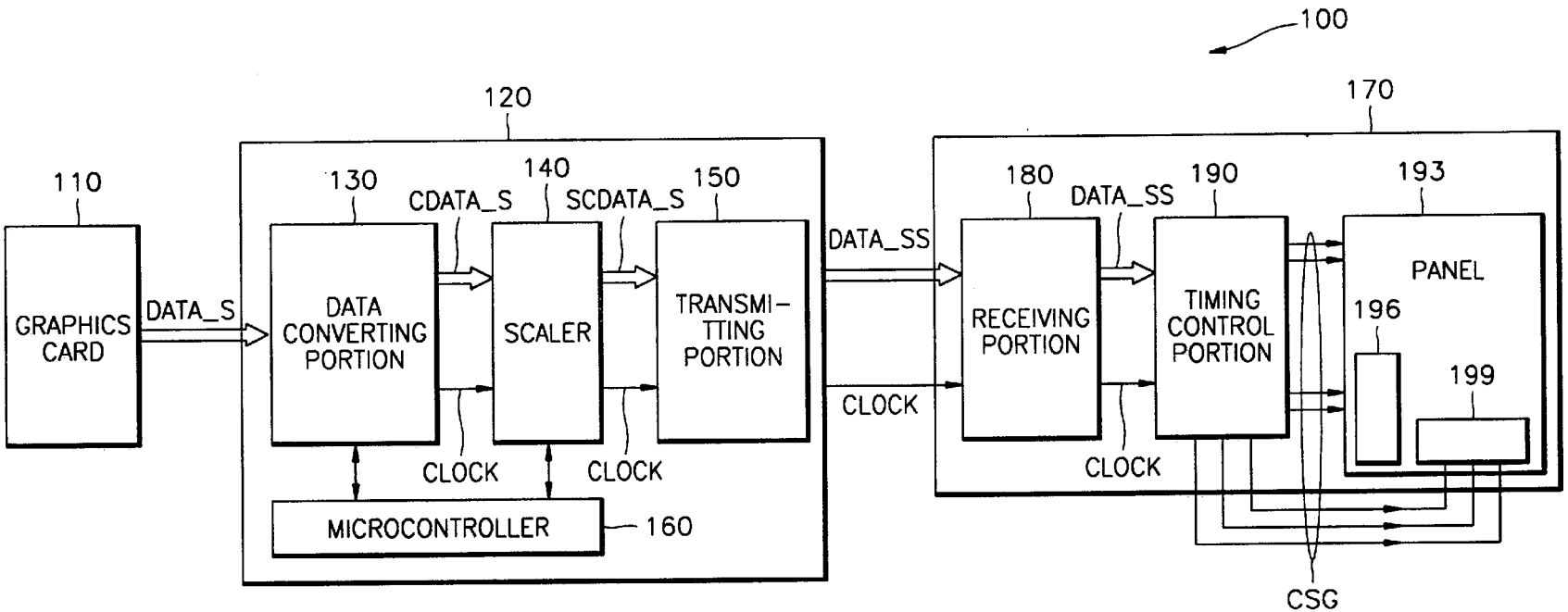
FIG. 1 (PRIOR ART)
FIG. 1 is a block diagram of a conventional liquid crystal display (LCD) panel driving apparatus.

In order to fully understand the present invention, the advantages of operation of the present invention, and the objects achieved by preferred embodiments of the present invention, the accompanying drawings illustrating the preferred embodiments of the present invention and the description of the drawings are referred to. The present invention will now be described more fully with reference to the accompanying drawings, in which preferred embodiments of the invention are shown. The same reference numerals in different drawings represent the same element.

Figure 2:
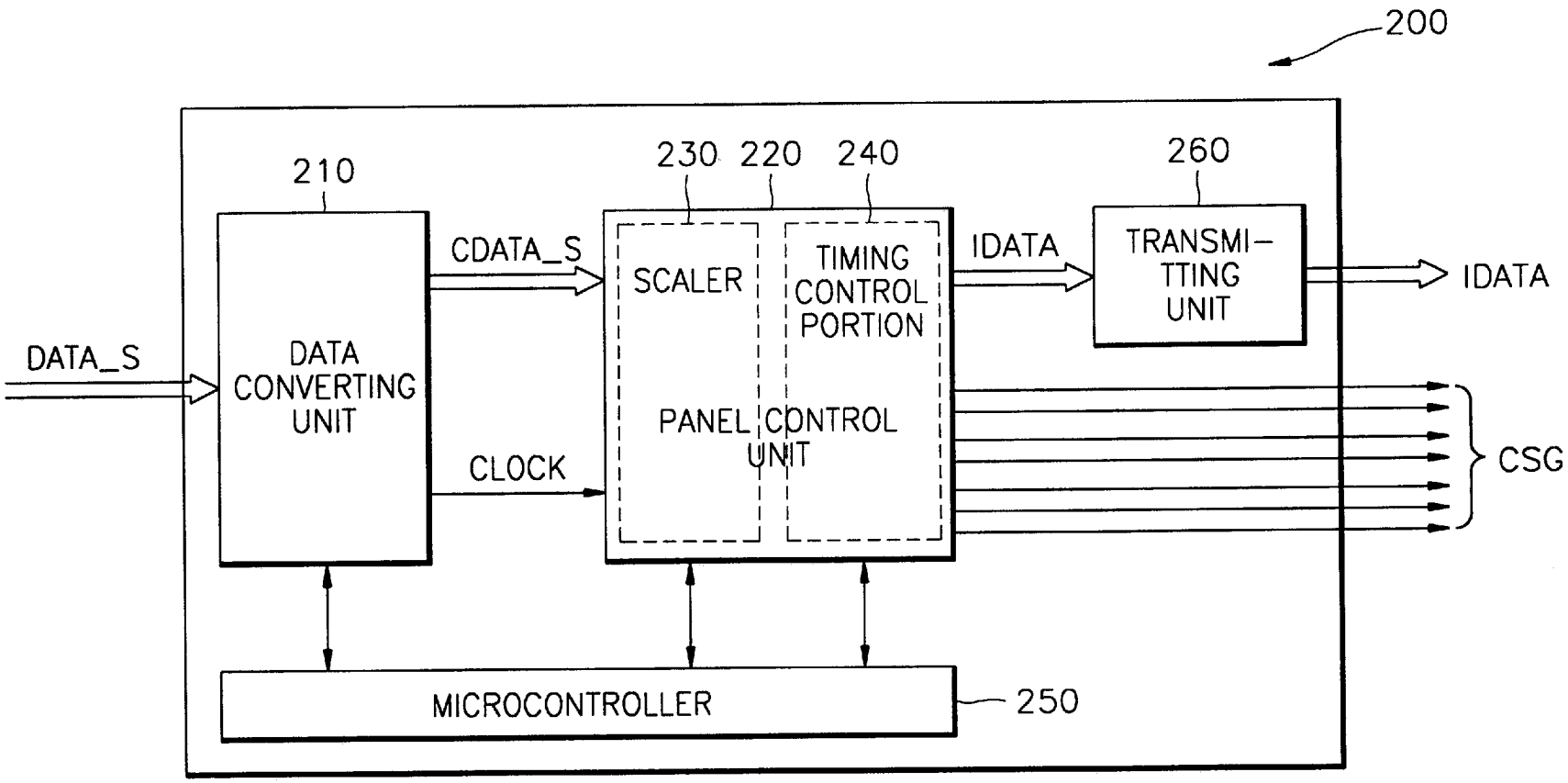
FIG. 2 is a block diagram of a first embodiment of a panel driving apparatus according to the present invention.

Referring to FIG. 2, a panel driving apparatus 200 according to a first embodiment of the present invention includes a microcontroller 250, a data converting unit 210, a panel control unit 220, and a transmitting unit 260.

The data converting unit 210 is controlled by the microcontroller 250, receives composite data DATA_S including color (RGB) data and horizontal and vertical synchronization signals (not shown), and generates converted composite data CDATA_S and a clock signal CLOCK. The panel control unit 220 is controlled by the microcontroller 250, receives the converted composite data CDATA_S and the clock signal CLOCK, and generates control signals CSG for controlling driving of an LCD panel and an internal data signal IDATA including the color data and the clock signal CLOCK. The transmitting unit 260 receives the internal data signal IDATA from the panel control unit 220 and transmits the internal data signal IDATA to the LCD panel.

The panel control unit 220 includes a scaler 230 for scaling the converted composite data CDATA_S to be suitable for the specifications of the LCD panel and a timing control portion 240 for generating the control signals CSG and the internal data signal IDATA.

Hereinafter, the operation of the panel driving apparatus 200 according to the first embodiment of the present invention will be described more fully with reference to FIG. 2.

Composite data DATA_S including color data, and horizontal and vertical synchronization signals (not shown) is transmitted from a graphics card (not shown) to the data converting unit 210. The color data are analog data having various resolutions, such as SXGA, XGA, SVGA, and VGA. The data converting unit 210 is controlled by the microcontroller 250 and serves as an analog-to-digital converter for converting the analog color data to a digital signal and as a phase locked loop (PLL) for generating a clock signal for the panel driving apparatus 200.

The scaler 230 of the panel control unit 220 is controlled by the microcontroller 250 and scales the converted composite data CDATA_S having various resolutions and graphics output formats to be acceptable for the specifications of the LCD panel.

The timing control portion 240 of the panel control unit 220 is controlled by the microcontroller 250 and generates the control signals CSG for controlling driving of the LCD panel and the internal data signal IDATA including the color data and the clock signal CLOCK. The timing control portion 220 is conventionally placed with, and before, the panel to control the same, but in the embodiment disclosed in the present invention, the timing control portion 220 is included in the panel control portion 220 along with the scaler 230. The timing control portion 240 generates a variety of control signals CSG for controlling various types of panels having different specifications and driver characteristics. These functions of the timing control portion 240 are controlled by the microcontroller 250.

The control signals CSG will now be described in greater detail. Panel control signals include source driver-related control signals, gate driver-related control signals, and panel-related control signals. A "horizontal scanning start" signal indicates the start of sampling and registering of the color data of one horizontal scanning period (H) to a source driver, and a "dump start" signal indicates the timing of dumping of the color data of the one horizontal scanning period (H) on the LCD panel. Also, timing signals such as a "vertical scanning start" signal for turning on vertical gate lines in synchronization with the "dump start" signal, a "clock pulse vertical" used as a clock signal for driving gate lines, and an "output enable" signal for controlling the ON-time of gate lines to prevent overlapping with the preceding gate line, are included. A liquid crystal phase-change driving signal or a data inversion driving signal is also included. In addition, a signal for determining a display direction and a signal for determining the output ports of drivers are included. All of these signals except for the "horizontal scanning start" signal are directly or indirectly related to the type of driver, and the characteristics and the resolution of the panel, and thus, they are under the control of the microcontroller 250. Therefore, it is possible to manufacture the timing control portion 240 to be compatible with a variety of LCD panels having different specifications by varying the start points and widths of these signals within a prescribed period.

In particular, according to the present invention, the width and position of the "dump start" signal is controlled during the invalid data period of the "data enable" time window. The "dump start" signal is controlled according to the type of driver. A "frame reset dump start" signal for drivers is controlled such that it is generated at an arbitrary point in the period of a vertical synchronization signal.

The duty and start point of the "clock pulse vertical" signal are also controlled, as well as the start point and pulse width of the "vertical scanning start" signal. The data inversion driving signal and the liquid crystal phase-change driving signal are made to be freely selected by considering a direct current (DC) voltage level signal and eight possible driving conditions.

Due to the increase in size and resolution of panels and the need for a high clock frequency for driving operation, the margin for precharging time at the gate lines of a panel becomes smaller. To compensate for this problem at the stage of driving, the "output enable" signal is controlled such that the pulse width and the output point of a "gate-on-pulse" from the driver are varied. The "output enable" signal is generated prior to the generation of the "dump start" signal, so as to be compatible with the characteristics of as many different types of panels as possible.

In addition, the data path is designed to be suitable for any driving configuration, whether the driver has a single port or dual ports, so that control timing can be appropriately varied depending on the driving scheme. The control signals for determining the amplitude or direction of the output of the driver are controlled by setting a register map of the micro controller 250.

The microcontroller 250 includes a variety of programmable control parameters for driving the LCD panel according to the specifications of the panel and applies the control parameters to the timing control portion 220. The control parameters will be described more fully below with reference to FIG. 3.

The transmitting unit 260 receives the internal data signal IDATA including the color data and the clock signal from the panel control unit 230 and transmits the same to the LCD panel. The transmitting unit 260 operates to adapt the protocol of the panel driving apparatus 200 to that of the LCD panel for receiving the internal data signal IDATA.

The panel driving apparatus 200 having these functions can be implemented in a single integrated circuit chip to control a variety of LCD panels having different specifications.

Figure 3:
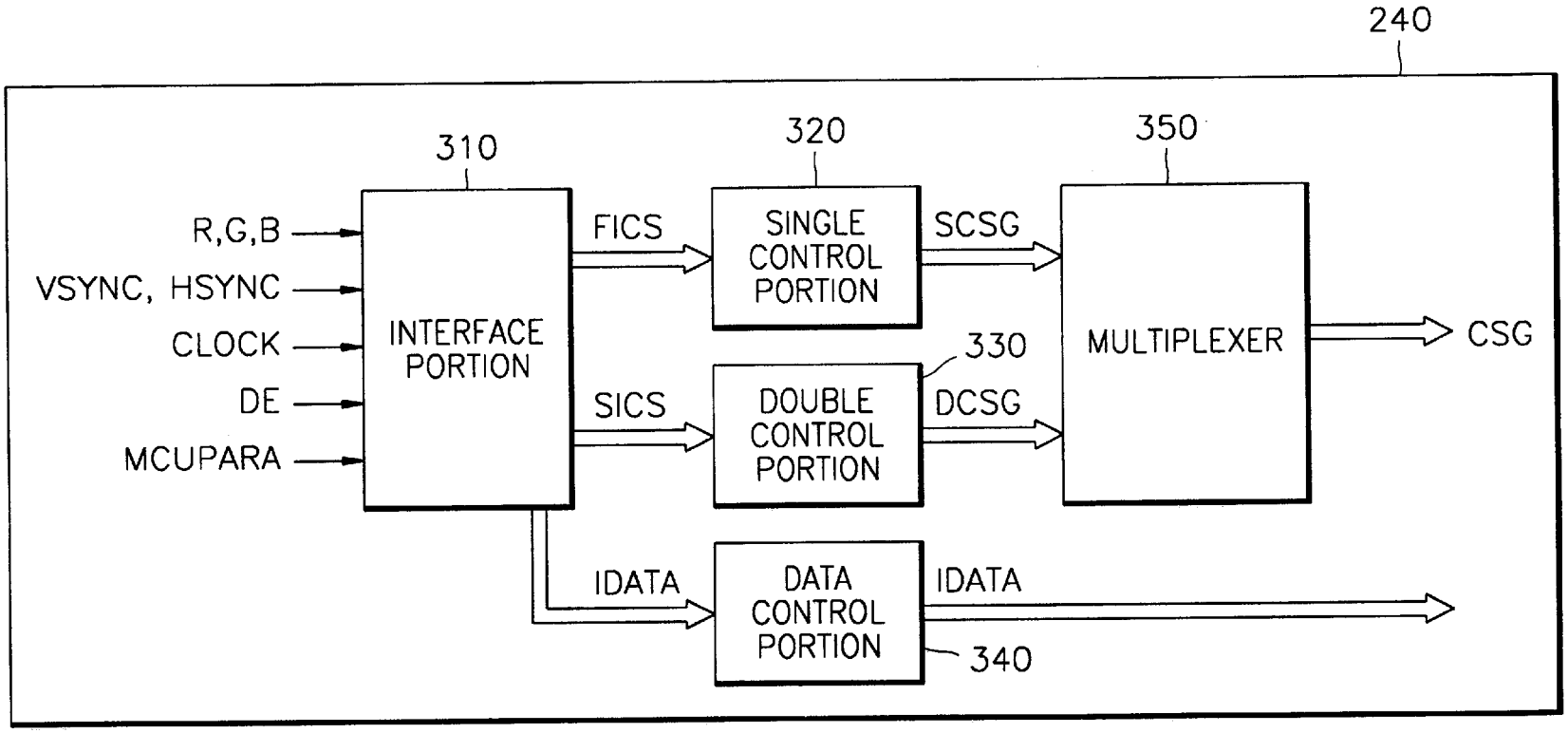
FIG. 3 is a block diagram of a timing control portion of FIG. 2.

Referring to FIG. 3, the timing control unit 240 includes an interface portion 310, a single control portion 320, a double control portion 330, a data control portion 340, and a multiplexer 350.

The interface portion 310 receives control parameters MCUPARA from the microcontroller 250 and the color data R, G, and B, the vertical and horizontal synchronization signals VSYNC and HSYNC, the clock signal CLOCK, and the data enable signal DE, and generates the internal data IDATA and first and second internal control signals FICS and SICS which are selected depending on the specifications of the LCD panel. The single control portion 320 receives the first internal control signal FICS and generates a single internal control signal SCSG for driving an LCD panel having particular specifications. The double control portion 330 receives the second internal control signal SICS and generates a double internal control signal DCSG for driving another LCD panel having different specifications. The data control portion 340 receives the internal data signal IDATA and transmits the received internal data signal IDATA to the transmitting unit 260. The multiplexer 350 selects one of the single internal control signal SCSG and the double internal control signal DCSG according to the specifications of the LCD panel employed and generates the selected signal as control signals CSG for the LCD panel.

Hereinafter, the operation of the timing control unit 240 will now be described more fully with reference to FIG. 3.

The interface portion 310 receives the color data R, G, and B, the horizontal and vertical synchronization signals HSYNC and VSYNC, the clock signal CLOCK, the data enable signal DE, and the control parameters MCUPARA, and transmits the color data R, G, and B and the clock signal CLOCK to the data control portion 340 as the internal data signal IDATA, and the horizontal and vertical synchronization signals HSYNC and VSYNC and the data enable signal DE to the single control portion 320 and the double control portion 330. The control parameters MCUPARA are appropriately transmitted to the single control portion 320, the double control portion 330, and the data control portion 340 according to their functions.

The control parameters MCUPARA will be described more fully. The control parameters MCUPARA are programmed and installed in the microcontroller 250, and transmitted to the timing control unit 240 to generate the control signals CSG for driving the LCD panel. The control parameters MCUPARA may be variously programmed according to panel manufacturing companies, panel specifications and driver characteristics, and then stored in the microcontroller 250.

The control parameters MCUPARA include parameters for determining the start and ending of data dumping, a parameter for determining the start of a frame reset counter, parameters for determining the start and ending of frame resetting, parameters for determining the start and ending of a vertical gate clock signal, parameters for determining the start and ending of precharging of the gate of TFTs, parameters for determining the start and ending of a vertical scanning signal, and a parameter for determining the size of horizontal pixels. Each of the parameters has a length of 11 bits and is stored in the microcontroller 250.

In addition, a parameter for indicating whether single or double data are input, a parameter for determining the data output direction of the source driver, a parameter for determining the data output direction of the gate driver, a parameter for determining the number of outputs of the source driver, a parameter for determining the number of outputs of the gate driver, and a parameter for determining whether to invert the vertical synchronization signal are stored in the microcontroller 250. Here, each of the parameters has a length of 1 bit.

A parameter for controlling the delay of a valid data enable signal, a parameter for controlling the delay of the vertical synchronization signal VSYNC, a parameter for determining the liquid crystal phase-change signal, and a parameter for determining the data inversion signal are stored in the microcontroller 250. Each of the parameters has a length of 3 bits.

The functions of the control parameters MCUPARA and generation of the control signals CSG according to the control parameters MCUPARA will now be described.

The control signals CSG are generated based upon the data enable signal DE and the vertical synchronization signal VSYNC in order to implement stable hardware interface with the panel driven by the control signals CSG.

Using a counter designed based upon the falling edge of the data enable signal DE, the width and position of the "dump start" signal, which is one of the control signals CSG, are freely determined during the logic-low period of the data enable signal DE (where data are valid when the data enable signal DE is logic high) before a next horizontal line sampling is started, based upon the parameters for determining the start and ending of data dumping.

The width and position of the "frame reset" signal, which is one of the control signals CSG, are freely determined by the counter during the enable period of the vertical synchronization signal VSYNC, based upon the parameters for determining the start and ending of frame resetting. The position of logic high of the "vertical scanning start" signal is freely determined during the logic high period of the "clock pulse vertical" signal, which is a clock signal for diving gate lines, before the "dump start" signal is enabled. In general, the "vertical scanning start" signal is initially set to have a length of 1.5 times that of the horizontal scanning period (H).

Using a counter that counts based on the rising edge of the "dump start" signal, which is one of the control signals CSG for applying a data voltage from drivers to the panel, the duty of the "clock pulse vertical" signal as a clock signal for driving gate lines is controlled to be 50%, based upon the parameters for determining the start and ending of the "clock pulse vertical" signal used as a clock signal for driving gate lines. The "liquid crystal phase-change driving" signal or "data inversion driving" signal as one of the control signals CSG is generated based upon the "clock pulse vertical" signal. The "liquid crystal phase-change" signal and "data inversion driving" signal are selected depending on operation mode by the parameters for determining the "liquid crystal phase-change driving signal and "data inversion driving" signal, respectively, and support high-voltage or low-voltage driving of data. Designing for line- or dot-based phase change of liquid crystal molecules is also possible.

When the vertical synchronization signal VSYNC is logic high, an 11-bit counter is generated during the logic low period of the vertical synchronization signal and VSYNC, and the "frame reset" signal is determined based upon the counter.

Signals related to the basic output direction of the control signals CSGs can be controlled by a register map of the micro controller 250. Due to a limitation of the sampling frequency of the source driver, panels with a resolution higher than SXGA or XGA are driven with dual ports, and additional control signals CSG for appropriate timing control are generated. A color data path is appropriately selected depending on whether driving is accomplished with dual ports or with a single port.

The first internal control signal FICS generated by the interface portion 310 is transmitted to the single control portion 320. The first internal control signal FICS includes the vertical and horizontal synchronization signals VSYNC and HSYNC, the data enable signal DE, and control parameters MCUPARA required for generating the single internal control signal SCSG. The single control portion 320 generates the single internal control signal SCSG as the control signals CSG required for driving the panel if the rate of the clock signal CLOCK is slower than that of the source driver.

The second internal control signal SICS generated by the interface portion 310 is transmitted to the double control portion 330. The second internal control signal SICS includes the vertical and horizontal synchronization signals VSYNC and HSYNC, the data enable signal DE, and control parameters MCUPARA required for generating the double internal control signal DCSG. The double control portion 330 generates the double internal control signal DCSG to be used as control signals CSG required for driving each of a first half and a second half of the panel when the rate of the clock signal CLOCK is faster than that of the source driver.

The internal data signal IDATA generated by the interface portion 310 is transmitted to the data control portion 340. The internal data signal IDATA includes the color data R, G, and B and the clock signal CLOCK. If the single internal control signal SCSG is output as the control signals CSG, the data control portion 340 generates the internal data signal (IDATA) as single data. If the double internal control signal DCSG is output as the control signals CSG, the data control portion 340 generates the internal data signal IDATA as double data. The term "double data" means that the individual color data R, G, and B is paired. The data control portion 340 transmits the inner data signal IDATA to the transmitting unit 260.

When the specifications of the panel employed is externally input, the multiplexer 350 selects one of the single internal control signal SCSG and the double internal control signal DCSG, and generates a selected control signal as the control signals CSG. Here, the control signals CSG and the internal data signal IDATA are simultaneously generated and transmitted to the panel.

Figure 4:
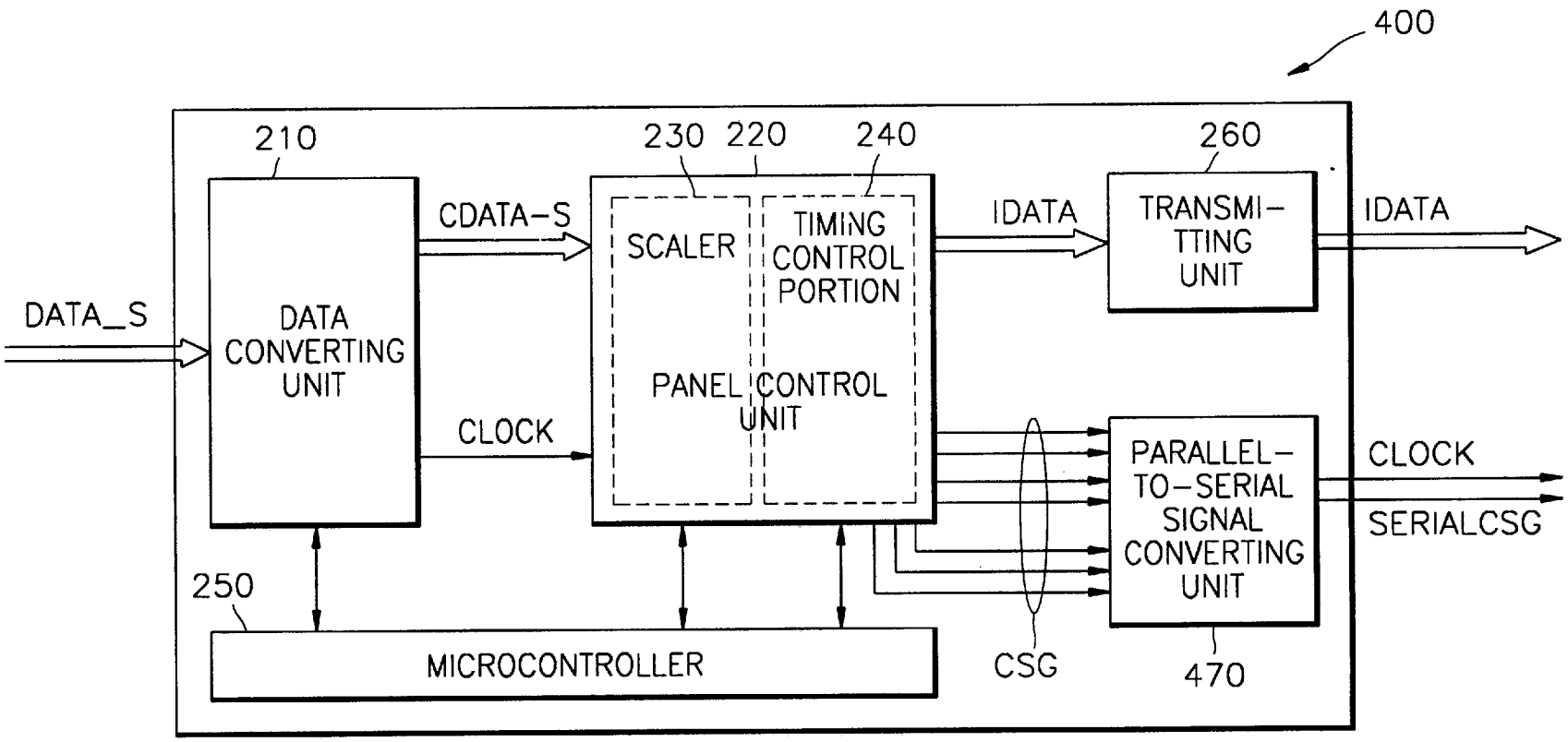
FIG. 4 is a block diagram of a second embodiment of a panel driving apparatus according to the present invention.

Referring to FIG. 4, a panel driving apparatus 400 according to a second embodiment of the present invention further includes a parallel-to-serial signal converting unit 470 for receiving the control signals CSG, converting the control signals CSG to serial control signals SERIALCSG, and transmitting the serial control signals SERIALCSG to the LCD panel, in comparison to the panel driving apparatus 200 according to the first embodiment of the present invention. The other elements, with the exception of the parallel-to-serial signal converting portion 470, are the same as those of the panel driving apparatus 200 according to the first preferred embodiment, and thus the structures and operations of the same elements will not be provided here.

In particular, the panel driving apparatus 400 converts the control signals CSG generated by the panel control unit 220, which are parallel, to the serial control signals SERIALCSG, and transmits the serial control signals SERIALCSG to the panel through two bus lines. The clock signal CLOCK is loaded into one of the bus lines and the serial control signals SERIALCSG are loaded into the other. Accordingly, the number of pins required for connection with an external device is advantageously reduced. The structure of the parallel-to-serial signal converting portion 470 having this function is known to those skilled in the art, and thus a detailed description thereof is not provided here.

Figure 5:
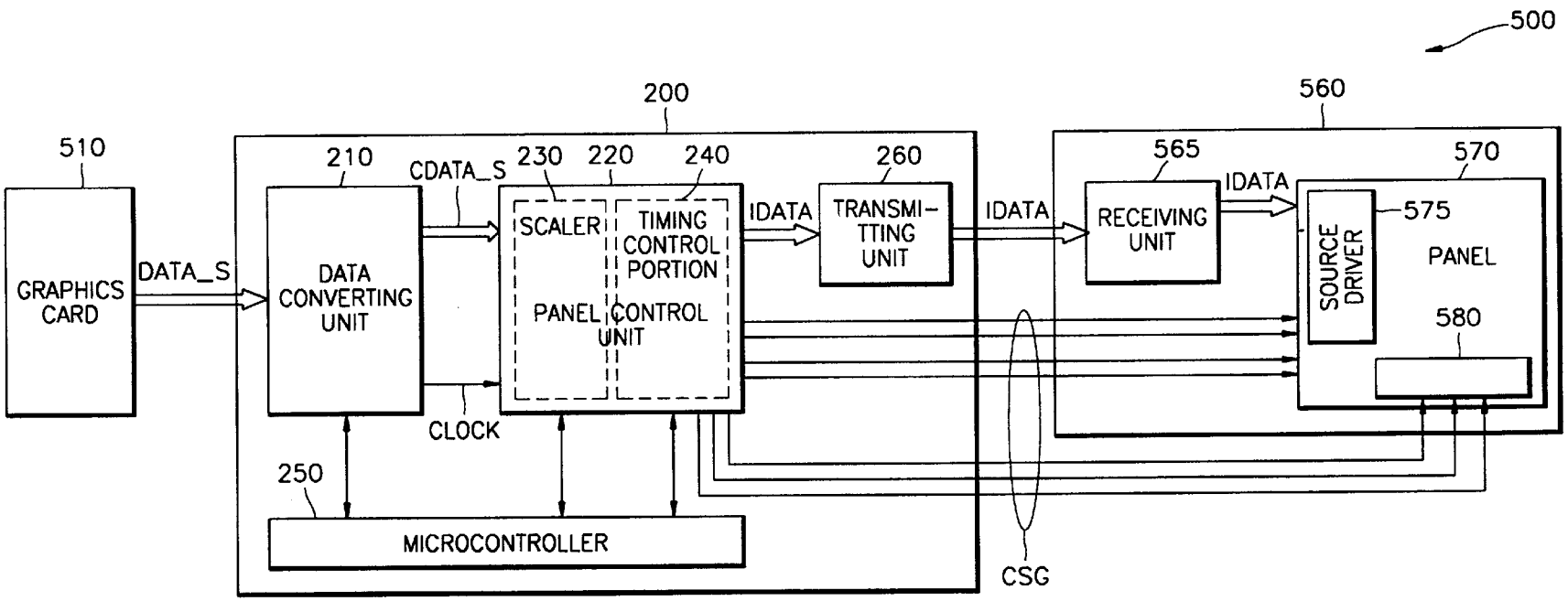
FIG. 5 is a block diagram of a first embodiment of an LCD panel driving system according to the present invention.

A first preferred embodiment of a LCD panel driving system adopting a panel driving apparatus according to the present invention is illustrated in FIG. 5. Referring to FIG. 5, the LCD panel driving system 500 includes a graphics card 510, a display device 560 having a panel 570, and a panel driving apparatus 200.

The panel driving apparatus 200 receives composite data DATA_S including color data and vertical and horizontal synchronization signals (not shown) from the graphics card 510, and generates control signals CSG and a predetermined internal data signal IDATA. The panel driving apparatus 200 includes a microcontroller 250, a data converting unit 210, a panel control unit 220, and a transmitting unit 260.

The data converting unit 210 is controlled by the microcontroller 250, receives and converts the composite data DATA_S, and generates a converted composite data CDATA_S and a clock signal CLOCK. The panel control unit 220 is controlled by the microcontroller 250, receives the converted composite data CDATA_S and the clock signal CLOCK, and generates the control signals CSG for controlling driving of the panel 570 and an internal data signal IDATA including the color data and the clock signal CLOCK. The transmitting unit 260 receives the internal data signal IDATA from the panel control unit 220 and transmits the internal data signal IDATA to the panel 570. The panel control unit 220 includes a scaler 230 for scaling the converted composite data CDATA_S to be suitable for the specifications of the panel 570 and a timing control portion 240 for generating the control signals CSG and the internal data signal IDATA.

The operation of the first embodiment of the panel driving system 500 according to the present invention will now be described more fully with reference to FIG. 5.

The graphics card 510 transmits the composite data DATA_S including analog color data having a variety of resolutions, and the horizontal and vertical synchronization signals, to the panel driving apparatus 200. The panel driving apparatus 200 generates the internal data signal IDATA, and the control signals CSG for controlling driving of the panel 570, based upon control parameters programmed and stored in the microcontroller 250. The functions and operations of the data converting unit 210, the panel control unit 220, the microcontroller 250, and the transmitting unit 260 are the same as described with reference to FIG. 2 above, and thus detailed descriptions thereof are not provided here. The control signals CSGS and the internal data signal IDATA generated by the panel driving apparatus 200 are transmitted to the display device 560 through a receiving unit 565. The receiving unit 565 applies a protocol, i.e., a transmission scheme, adapted to the transmitting unit 260, and transmits the internal data signal IDATA to the panel 570.

A source driver 575 is driven by a "start horizontal signal", which is one of the control signals CSGs, for indicating the start of sampling and registering the color data, and a "dump start signal" for indicating the timing of dumping the color data on the panel 570. A liquid crystal phase-change driving signal and a data inversion driving signal are directly transmitted to the panel 570. A gate driver 580 is driven by a "clock pulse vertical signal" as a clock signal for driving gate lines, a "start vertical signal" for turning on vertical gate lines in synchronization with the "dump start signal", and an "output enable input signal" for controlling the ON-time of gate lines to prevent overlapping with the preceding gate line.

The panel driving apparatus 200 generates the control signals CSG for controlling the panel 570, which are compatible with a variety of panels having different specifications, by the microcontroller 250. Thus, there is no need for manufacturing a controller as an ASIC for a specific panel.

In the first embodiment of the panel driving system 500 according to the present invention, the panel driving apparatus 200 may be implemented as a single chip and may be installed in the display device 560, thereby realizing a one-chip solution for monitor systems. Alternatively, if the composite data DATA_S generated by the graphics card 510 are digital signals, the data converting unit 210 and the scaler 230 may be removed from the data panel driving system 500. In this case, the timing control portion 240 for generating a variety of control signals CSG may be mounted in the graphics card 510 and controlled with a program (for example, a Microsoft Windows program) by a central processing unit, thereby enabling a one-chip solution for digital graphics card systems.

Figure 6:
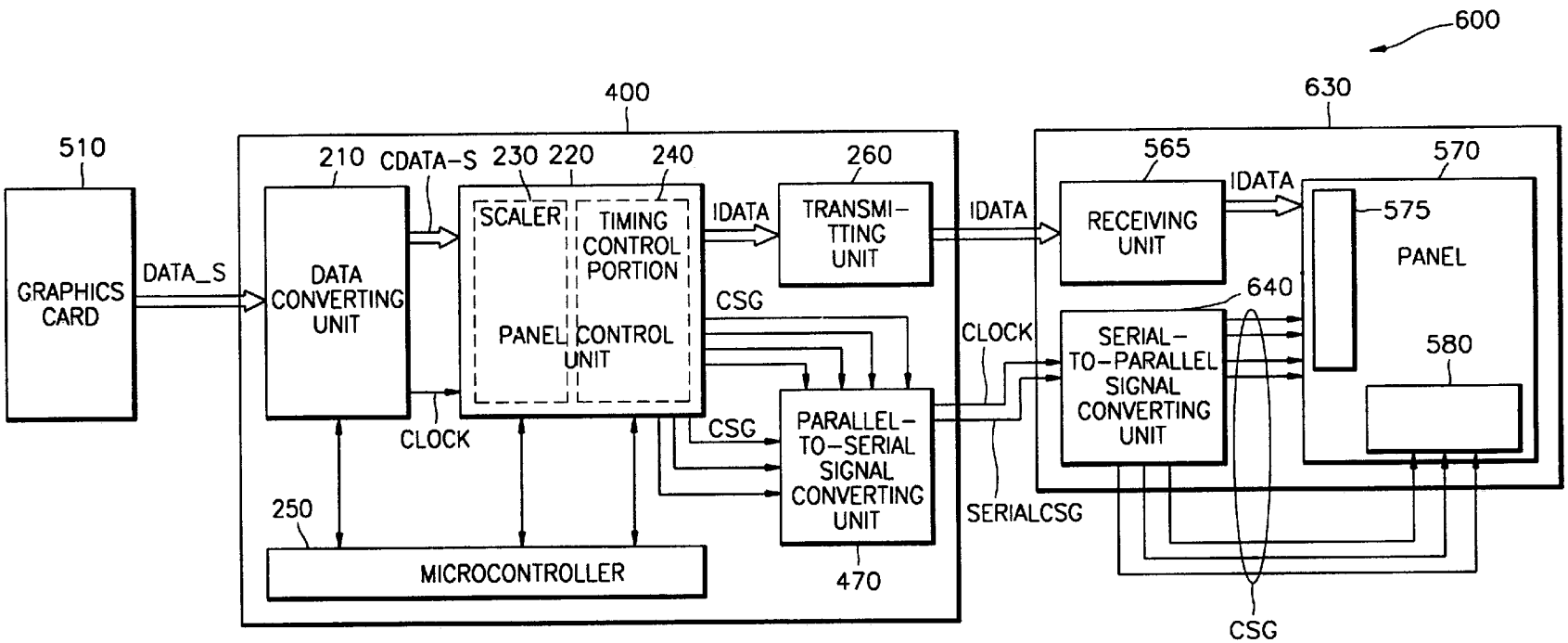
FIG. 6 is a block diagram of a second embodiment of an LCD panel driving system according to the present invention.

Referring to FIG. 6, unlike the first embodiment of the panel driving system 500 of FIG. 5, a second embodiment of a panel driving system 600 according to the present invention further includes a parallel-to-serial signal converting unit 470 for receiving the control signals CSG and converting the control signals CSG, which are parallel, to serial control signals SERIALCSG, and transmitting the serial control signals SERIALCSG to the panel 570, and a serial-to-parallel signal converting unit 640 for receiving the serial control signals SERIALCSG, converting the serial control signals SERIALCSG back to the original parallel control signals CSG, and transmitting the parallel control signals CSG to the panel 570. The other elements of the panel driving system 500 are the same as described in the first embodiment of the panel driving system 500, and thus the structures and operations of the same elements will not be provided here.

In particular, the parallel-to-serial signal converting unit 470 of the panel driving system 600 converts the control signals CSG generated by the panel control apparatus 220, which are parallel, to the serial control signals SERIALCSG, and transmits the serial connect signal SERIALCSG to the serial-to-parallel signal converting unit 640 connected to the same through two bus lines: one for the clock signal CLOCK and the other for the serial control signals SERIALCSG. The serial control signal SERIALCSG is converted back to the original parallel control signals CSG by the serial-to-parallel signal converting unit 640. As a result, the number of pins required to connect the panel driving apparatus 400 and the display apparatus 630 with an external device are advantageously reduced. The structures of the parallel-to-serial signal converting unit 470 and the serial-to-parallel signal converting unit 640 are known to those skilled in the art, and thus detailed descriptions thereof will not be provided here.

As described above, the LCD panel driving apparatus and the panel driving system adopting the LCD panel driving apparatus according to the present invention generate a variety of control signals, which are programmed by a microcontroller depending on the specifications for a particular panel, and thus they are applicable to various types of the panels having different specifications, without need to be manufactured as ASICs, thereby reducing manufacturing cost. The panel driving apparatus compatible with various types of the panels can be implemented as a single chip. A monitor system can also be implemented as a single chip by mounting the panel driving apparatus in a display apparatus.

In the drawings and specification, there have been disclosed typical preferred embodiments of the invention, and although specific terms are employed, they are used in a generic and descriptive sense only and not for purpose of limitation, the scope of the invention being set forth in the following claims.

What is claimed is:

1. A panel driving apparatus for driving with various types of panels for liquid crystal displays (LCDs) having different specifications, the apparatus comprising:

a microcontroller;

a data converting unit controlled by the microcontroller, for receiving composite data including color data and horizontal and vertical synchronization signals, and for generating converted composite data and a clock signal;

a panel control unit controlled by the microcontroller, for receiving the converted composite data and the clock signal, and for generating control signals for driving a panel and an internal data signal including the color data and the clock signal, the panel control unit comprising:

a scaler for scaling the converted composite data according to the specifications of the panel; and a timing control portion for generating the control signals and the internal data signal, wherein the microcontroller programs a variety of control parameters according to the specifications of the panel, stores the control parameters, and transmits the control parameters to the timing control portion, the timing control portion comprising an interface portion for receiving the color data, the horizontal and vertical synchronization signals, a data enable signal, and the control parameters from the microcontroller, and for generating first and second internal control signals and the internal data signal according to the specifications of the panel;

a single control portion for receiving the first internal control signal and generating a single internal control signal for driving a panel only if a rate of the clock signal is less than a rate of a source driver of the panel;

a double control portion for receiving the second internal control signal and generating a double internal control signal for driving the panel only if the rate of the clock signal is greater than the rate of the source driver of the panel;

a data control portion for receiving the internal data signal and transmitting the received internal data signal to the transmitting unit; and a multiplexer for selecting one of the single internal control signal and the double internal control signal according to the specifications of the panel employed and generating the selected control signal as one of the control signals for driving the panel; and a transmitting unit for receiving the internal data signal from the panel control unit and transmitting the received internal data signal to the panel.

2. The panel driving apparatus of claim 1, further comprising a parallel-to-serial signal converting unit for receiving the control signals, for converting the received control signals to serial control signals, and for transmitting the serial control signals to the panel.

3. A panel driving system for driving with various types of panels for liquid crystal displays (LCDs) having different specifications, the panel driving system comprising:

a display device including a panel; and a panel driving apparatus for receiving composite data including color data and vertical and horizontal synchronization signals from a graphics card and generating control signals for driving the panel and a predetermined internal data signal, the panel driving apparatus including:

a microcontroller;

a data converting unit controlled by the microcontroller, for receiving the composite data including the color data and the horizontal and vertical synchronization signals, and for generating converted composite data and a clock signal;

a panel control unit controlled by the microcontroller, for receiving the converted composite data and the clock signal and generating the control signals for driving the panel, and rod, the predetermined internal data signal including the color data and the clock signal the panel control unit comprising:

a scaler for scaling the converted composite data according to the specifications of the panel; and a timing control portion for generating the control signals and the internal data signal, wherein the microcontroller programs a variety of control parameters according to the specifications of the panel, stores the control parameters, and transmits the control parameters to the timing control portion, the timing control portion comprising an interface portion for receiving the color data, the horizontal and vertical synchronization signals, a data enable signal, and the control parameters from the microcontroller, and for generating first and second internal control signals and the internal data signal according to the specifications of the panel;

a single control portion for receiving the first internal control, signal and for generating a single internal control signal for driving a panel only if a rate of the clock signal is less than a rate of a source driver of the panel;

a double control portion for receiving the second internal control signal and for generating a double internal control signal for driving the panel only if the rate of the clock signal is greater than the rate of the source driver of the panel;

a data control portion for receiving the internal data signal and transmitting the received internal data signal to the transmitting unit; and a multiplexer for selecting one of the single internal control signal and the double internal control signal according to the specifications of the panel employed and generating the selected control signal as one of the control signals for driving the panel; and a transmitting unit for receiving the predetermined internal data signal from the panel control unit and transmitting the received predetermined internal data signal to the panel.

4. The panel driving system of claim 3, further comprising a parallel-to-serial signal converting unit for receiving the control signals, for converting the received control signals to serial control signals, and for transmitting the serial control signals to the panel.

5. The panel driving system of claim 4, wherein the display device further comprises a serial-to-parallel signal converting unit for receiving the serial control signals, for converting the serial control signals to parallel control signals, and for transmitting the parallel control signals to the panel.

* * * * *

UNITED STATES PATENT AND TRADEMARK OFFICE

CERTIFICATE OF CORRECTION

PATENT NO. : 6,816,139 B2
DATED : November 9, 2004
INVENTOR(S) : Kwan-seon Park

It is certified that error appears in the above-identified patent and that said Letters Patent is hereby corrected as shown below:

Column 12,
Lines 6 and 65, delete “with” after “driving”.

Column 13,
Line 17, delete “rod,” after “and”.

Column 14,
Line 2, delete the “,” after “control”.

Signed and Sealed this

First Day of March, 2005

JON W. DUDAS
*Director of the United States Patent and Trademark Office*